US010510235B2

(12) United States Patent
Wei et al.

(10) Patent No.: US 10,510,235 B2
(45) **Date of Patent: *Dec. 17, 2019**

(54) TIME-REVERSAL INDOOR DETECTION SYSTEM AND METHOD

(71) Applicant: WISTRON NEWEB CORPORATION, Hsinchu (TW)

(72) Inventors: Ya-Ping Wei, Hsinchu (TW); Chieh-Wen Cheng, Hsinchu (TW); Horen Chen, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 13 days.

This patent is subject to a terminal disclaimer.

(21) Appl. No.: 15/935,676

(22) Filed: Mar. 26, 2018

(65) Prior Publication Data

US 2019/0114888 A1 Apr. 18, 2019

Related U.S. Application Data

(60) Provisional application No. 62/573,164, filed on Oct. 17, 2017.

(51) Int. Cl.
*G08B 13/19* (2006.01)
*G08B 13/196* (2006.01)

(52) U.S. Cl.
CPC ..... *G08B 13/19695* (2013.01); *G08B 13/19* (2013.01); *G08B 13/1966* (2013.01); *G08B 13/19669* (2013.01)

(58) Field of Classification Search
CPC .... G08B 25/004; G08B 25/007; G08B 13/19; G08B 13/1966; G01S 5/0215; G01S 5/0221; G01S 5/0252; G01S 5/0273
See application file for complete search history.

(56) References Cited

U.S. PATENT DOCUMENTS 8,331,544 B2 * 12/2012 Kraus ..... G07C 9/00944 340/5.7
8,922,649 B2 * 12/2014 Kim ..... G08B 13/19645 348/143
9,179,105 B1 * 11/2015 Zeira ..... H04N 5/2254
9,218,696 B2 * 12/2015 Dumas ..... G07C 9/00571
9,389,301 B2 * 7/2016 Huang ..... G01S 5/0205
9,948,905 B2 * 4/2018 Peng ..... H04N 7/186
10,168,414 B2 * 1/2019 Chen ..... G01S 5/0252
(Continued)

*Primary Examiner* — Hai Phan
*Assistant Examiner* — Son M Tang
(74) *Attorney, Agent, or Firm* — Li & Cai Intellectual Property (USA) Office

(57) ABSTRACT

A time-reversal indoor detection system and method are provided. The system includes an anchor node device, an access point (AP) device, and a first electronic device. The first wireless communication circuit of the anchor node device is configured to send a probe signal, a third wireless communication circuit of the access point device is configured to receive the probe signal, a processor is configured to obtain a current CSI from the probe signal, and to compare the current CSI to a preset CSI, and when a first CSI included in the preset CSI is matched to the current CSI, a second wireless communication circuit of the anchor node device is configured to activate at least one function of a first electronic device through a second communication protocol.

18 Claims, 8 Drawing Sheets

(56) References Cited

U.S. PATENT DOCUMENTS

2003/0046541 A1* 3/2003 Gerdes ..... G06F 21/31 713/168
2003/0206100 A1* 11/2003 Richman ..... G08B 13/19608 340/506
2006/0214767 A1* 9/2006 Carrieri ..... G07C 9/00158 340/5.61
2006/0250578 A1* 11/2006 Pohl ..... G06F 3/0238 351/210
2008/0007620 A1* 1/2008 Wang ..... H04N 5/232 348/154
2009/0059002 A1* 3/2009 Kim ..... G08B 13/19645 348/143
2011/0102588 A1* 5/2011 Trundle ..... G08B 13/196 348/143
2012/0213061 A1* 8/2012 Chen ..... H04W 16/14 370/227
2015/0023441 A1* 1/2015 Koo ..... H04B 7/0456 375/267
2015/0067792 A1* 3/2015 Benoit ..... H04W 12/04 726/5
2015/0247915 A1* 9/2015 Huang ..... G01S 5/0205 455/456.1
2015/0257167 A1* 9/2015 Chen ..... H04W 4/70 370/330
2016/0138824 A1* 5/2016 Patel ..... F24F 11/30 700/276
2016/0165663 A1* 6/2016 Shanmugam ..... H04W 76/10 370/338
2016/0171808 A1* 6/2016 Caterino ..... G07C 9/00309 340/5.61
2016/0189503 A1* 6/2016 Johnson ..... G07C 9/00571 348/152
2016/0269691 A1* 9/2016 Lee ..... H04M 11/025
2017/0026147 A1* 1/2017 Smith ..... H04K 3/41
2017/0116800 A1* 4/2017 Lin ..... B60R 25/01
2017/0212210 A1* 7/2017 Chen ..... G01S 5/06
2018/0340350 A1* 11/2018 Johnson ..... G08B 3/10
2019/0007256 A1* 1/2019 Chen ..... H04W 72/0413
2019/0132558 A1* 5/2019 Lu ..... H04N 7/188

* cited by examiner

TIME-REVERSAL INDOOR DETECTION SYSTEM AND METHOD

RELATED APPLICATIONS

The present invention claims priority to U.S. Provisional Patent Application No. 62/573,164, filed on Oct. 17, 2017, the entire disclosure of which is hereby incorporated by reference.

BACKGROUND OF THE INVENTION

1. Field of the Invention

The present disclosure relates to a time-reversal indoor detection system and method, and in particular, to a time-reversal indoor detection system and method that may utilize TR process to detect events occurring in an indoor space while activating functions of electronic devices through certain wireless communication protocols accordingly.

2. Description of Related Art

According to the architecture of existing home protection systems, the required elements are a camera, a passive infrared (PIR) sensor, and a wireless device. When the built-in PIR sensor is triggered, the camera starts to take pictures or record videos. The wireless device in the architecture can communicate with a wireless access point for data transmission. The wireless access point is responsible for uploading the data to the network or cloud server for data storage, data consolidation, data classification and other functions. The camera may be a battery powered wireless device, which may be placed in different areas based upon the respective uses of those areas.

When no event requiring that a picture be taken or a video be recorded is detected, the camera operates in sleep mode for extending battery life. The PIR sensor is used to detect motion. When the PIR sensor is triggered, the camera will wake from the sleep mode to take pictures or record videos. The images will then be uploaded to a cloud storage to be saved, and the user will be notified accordingly.

Users may also use the mobile device to send commands to the camera to record real-time videos via the Internet, allowing users to view real-time images on mobile devices.

However, the PIR sensor is susceptible to ambient temperature, which may cause false alarms. In the architecture of cameras with built-in PIR sensors, even when the camera operates under sleep mode, the PIR sensor will still need to perform continuous detection, which already consumes power, so that any recording action caused by the false alarm would consume an excess amount of extra power.

SUMMARY OF THE INVENTION

According to an embodiment of the present disclosure, there is provided a time-reversal indoor detection system including an anchor node device, an access point (AP) device, and a first electronic device. The anchor node device includes a first wireless communication circuit having a first communication protocol, and a second wireless communication circuit having a second communication protocol. The AP device includes a processor, a memory, and a third wireless communication circuit. The memory connects to the processor, configured to store a preset channel state information (CSI), and the preset CSI includes a first CSI and a normal CSI. The third wireless communication circuit has the first communication protocol and connects to the processor, communicating with the first wireless communication circuit through the first communication protocol within an indoor space. The first electronic device includes a fourth wireless communication circuit having the second communication protocol, and communicating with the second communication circuit through the second communication protocol. The first wireless communication circuit is configured to send a probe signal, the third wireless communication circuit is configured to receive the probe signal, the processor is configured to obtain a current CSI from the probe signal, and to compare the current CSI to the preset CSI, and when the first CSI is matched to the current CSI, the second wireless communication circuit is configured to activate at least one function of the first electronic device through the second communication protocol.

According to another embodiment of the present disclosure, there is provided a time-reversal indoor detection method, including: communicating a first wireless communication circuit of an anchor node device with a third wireless communication circuit of an access point device through a first communication protocol within an indoor space, wherein the access point device further comprises a processor, and a memory connected to the processor, the memory is configured to store a preset channel state information (CSI), and wherein the preset CSI includes a first CSI and a normal CSI; communicating a second communication circuit of the anchor node device with a fourth wireless communication circuit of a first electronic device through a second communication protocol; configuring the first wireless communication circuit to send a probe signal; configuring the third wireless communication circuit to receive the probe signal; and configuring the processor to obtain a current CSI from the probing signal, and to compare the current CSI to the preset CSI. When the first CSI is matched to the current CSI, the second communication circuit is configured to activate at least one function of the first electronic device through the second communication protocol.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the disclosure are set forth in the appended claims. The disclosure itself, however, as well as modes of use, further objectives and advantages thereof, will best be understood with reference to the following detailed description of exemplary embodiments of the present disclosure when read in conjunction with the accompanying drawings, wherein:

DETAILED DESCRIPTION OF THE PREFERRED EMBODIMENTS

Figure 1A:
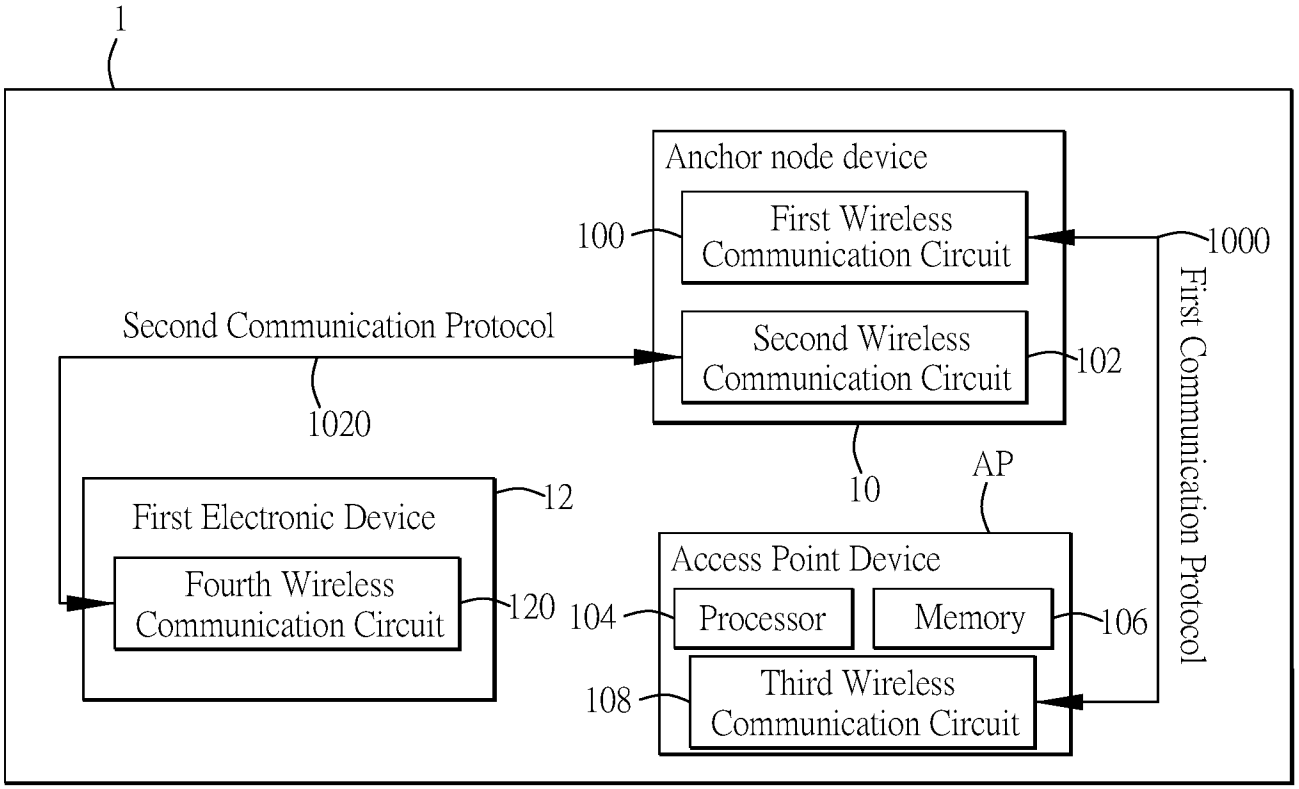
FIG. 1A shows a block diagram of a time-reversal indoor detection system in accordance with an exemplary embodiment.
Figure 1B:
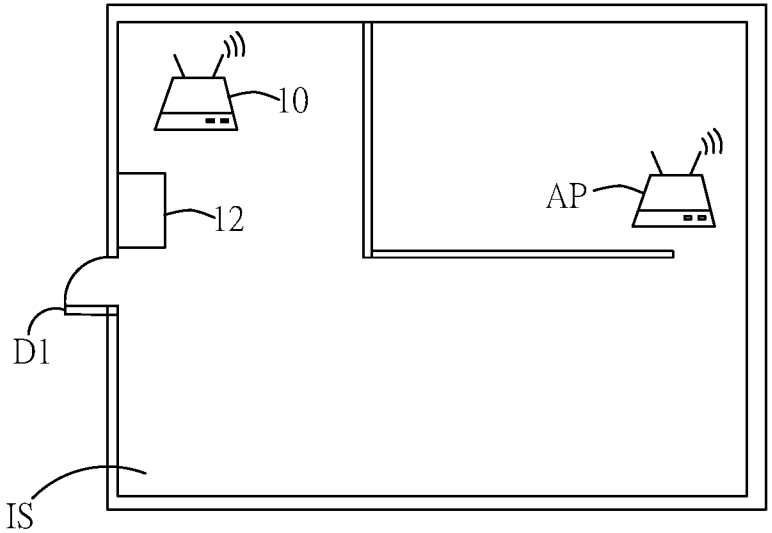
FIG. 1B shows a schematic diagram illustrating a layout of the time-reversal indoor detection system according to an embodiment of the present disclosure.

Referring more particularly to the drawings, embodiments of the disclosure may be described in the context of the structure detection system as shown in FIGS. 1A and 1B.

As shown in FIGS. 1A and 1B, which provide a block diagram of a time-reversal indoor detection system in accordance with an exemplary embodiment, and a schematic diagram illustrating a layout of the time-reversal indoor detection system according to an embodiment of the present disclosure. The time-reversal indoor detection system 1 may be implemented in any type of computing device. In this embodiment, the time-reversal indoor detection system 1 may include an anchor node device 10, an access point device AP, and a first electronic device 12. The anchor node device 10 may be a transceiver, which include a first wireless communication circuit 100 and a second wireless communication circuit 102. The first wireless communication circuit 100 supports a first communication protocol 1000, and the second wireless communication circuit 102 supports a second communication protocol 1020. The first wireless communication circuit 100 and the second wireless communication circuit 102 are used to receive and transmit wireless signals having different working frequencies.

In the exemplary embodiment, the first wireless communication circuit 100 (e.g., Wi-Fi circuit or other wireless communication circuitry) is configured to allow the anchor node device 10 to communicate with access point device AP through the first communication protocol 1000. The first communication protocol 1000 may be wireless communication standard, such as, IEEE 802.11, 3G/4G/5G standards.

Moreover, the second wireless communication circuit 102 (e.g., Bluetooth®, Z-Wave® or Zigbee circuit or other wireless communication circuitry) to allow the anchor node device 10 to communicate with one or more other electronic devices through the second communication protocol 1020. The second communication protocol 1020 may be any Bluetooth®, Z-Wave® or Zigbee standards or other similar wireless protocols which are low power radio technology.

In the exemplary embodiment, an operation power of the first wireless communication circuit 100 may be higher than an operation power of the second wireless communication circuit 102.

The time-reversal indoor detection system 1 may also include the access point device AP. The access point (AP) device includes a processor 104, a memory 106 connected to the processor 104, and a third wireless communication circuit 108. The processor 104 is served to execute instructions of software or firmware that may be loaded into the memory 106. The processor 104 may be a set of one or more processors or may be a multi-processor core, depending on the particular implementation.

The memory 106, in these examples, may be a random access memory, a hard drive, a flash memory, a rewritable optical disk, a rewritable magnetic tape, or any combination thereof. In the exemplary embodiment, the third wireless communication circuit 108 (e.g., Wi-Fi circuit or other wireless communication circuitry) connects to the processor 104, and may be configured to allow the access point device AP to communicate with the first wireless communication circuit 100 of the anchor node device 10 through the first communication protocol 1000. The third wireless communication circuit 108 may also support the first communication protocol 1000.

In this embodiment, the first wireless communication circuit 100 and the third wireless communication circuit 108 may each include an antenna, the first wireless communication circuit 100 launches a wireless signal that propagates through a wireless channel and arrives at the third wireless communication circuit 108 as a multipath wireless signal.

The processor 104 may be further configured to control the antenna of the third wireless communication circuit 108 to transmit/receive signals in different frequency bands, in different directions, and/or in different polarizations, in the same or similar frequency bands, in the same or similar directions, and/or in the same or similar polarizations. In some embodiments, the processor 104 may adjust carrier frequency, direction and/or polarization of signal transmissions and signal receptions. the third wireless communication circuit 108 is complied with the IEEE 802.11 standard. The IEEE 802.11 standard includes at least one of IEEE 802.11a/b/g/n/ac/ad standards.

The time-reversal indoor detection system 1 further includes a first electronic device 12. The first electronic device 12 may be an electronic-controlled lamp, door lock, camera, audio system or some other intelligent appliances, which is equipped with a fourth wireless communication circuit 120.

In the exemplary embodiment, the fourth wireless communication circuit 120 (e.g., Bluetooth®, Z-Wave® or Zigbee circuit or other wireless communication circuitry) may be configured to allow the first electronic device 12 to communicate with the anchor node device 10 through the second communication protocol 1020.

In the present embodiment, the time-reversal indoor detection system 1 is a detection system adapted to an indoor environment, which detects anomalies based on indoor events. The system is capable of through-the-wall indoor events detections with one pair of single-antenna devices. In the wireless transmission, the multipath is the propagation phenomenon that the RF signals reaches the receiving antenna through two or more different paths.

Specifically, the time-reversal indoor detection system utilizes TR technique to capture small variations in the multipath CSI. CSI is information that can represent the channel properties of a communication link to thereby estimate the channel. More specifically, CSI describes how a signal propagates from the transmitter(s) to the receiver(s) and reveals the combined effect of, for instance, scattering, fading, and power decay with distance.

In detail, during a channel probing phase, the transceiver A sends an impulse to the transceiver B, which produces an estimated CSI for the multipath channel between the transceivers A and B. Then, the corresponding characteristic parameters of CSI is obtained by time-reversing and conjugating the estimated CSI. During a TR transmission phase, the transceiver B transmits back the time-reversed and conjugated CSI and generates a spatial-temporal resonance at the transceiver A by fully collecting and concentrating the energy of the multipath channel. The TR spatial-temporal resonance can be viewed as the resonance of EM field in response to the environment, also known as the TR focusing effect.

When the event occurs, the received multipath profile varies correspondingly. As a consequence, the spatial-temporal resonance at the receiver side changes and can be used to track the events in the indoor space IS.

Now turning to the embodiment provided in FIGS. 1A and 1B. In a detection operation, the first wireless communication circuit 100 is configured to send a probe signal, the third wireless communication circuit 108 is configured to receive the probe signal, and the processor 104 is configured to obtain a current CSI from the probe signal.

The memory 106 may store a preset channel state information (CSI), and the preset CSI includes a first CSI and a normal CSI. Specifically, the first CSI and the normal CSI are respectively obtained by performing a time-reversal operation on the probe signal in response to a first event and a normal event occurred in the indoor space IS. The normal event may be defined as that there's not any invasion event occurred in the indoor space IS, and the first event may be defined as that a door D1 is open.

The processor 104 is further configured to compare the current CSI with the normal CSI and the first CSI, and when the first CSI is matched to the current CSI, the second wireless communication circuit 102 is configured to activate at least one function of the first electronic device 12 through the second communication protocol 1020.

In more detail, the time-reversal indoor detection system 1 of the present embodiment exploits the intrinsic property of TR technique that the spatial-temporal resonance fuses and compresses the information of the multipath propagation environment. To implement the indoor events detection based on the TR spatial-temporal resonances, the detection operation consists of two phases: the offline training and the online testing. The literature "Q. Xu, Y. Chen, B. Wang and K. J. R. Liu, "Time reversal based wireless events detection," 2017 *IEEE International Conference on Acoustics, Speech and Signal Processing* (*ICASSP*), New Orleans, La., 2017, pp. 5990-5994" describing how the database is built in a TR based indoor events detection system.

During the offline training phase, a database is built where the multipath profiles of any targets are collected and stored as the TR signatures.

Suppose there are a plurality of Events $S_i$, where i=1~n, the Events $S_i$ represent a variety of indoor events defined by the user. The corresponding training CSI samples are estimated and form a matrix $H_i$, which is defined as following equation (1):

$$H_i=[h_{i,t0},h_{i,t1},\ldots,h_{i,tN-1}] \tag{1}$$

where N is the size of CSI samples for a training event. $h_{i,tj}$ represents the estimated CSI vector of event $S_i$ at time tj and $H_i$ is named as the CSI matrix for event $S_i$. The corresponding TR signature matrix $G_i$ can be obtained by time-reversing the conjugated version of $H_i$ as following equation (2):

$$G=[h_{i,t0},h_{i,t1},\ldots,h_{i,tN-1}] \tag{2}$$

where the TR signature $g_{i,tj}|k|=h^*_{i,tj}|L-k|$ is the time-reversed and conjugated version of $h_{i,tj}$. Here, the superscript * on a vector variable represents the conjugate operator. L denotes the length of CSI, and k denotes the index of taps. Then the training database G is the collection of $G_i$'s. The training database G is then stored in the memory 106.

After constructing the training database G, the time-reversal indoor detection system 1 is ready for real-time indoor event detection. In this regards, the event is detected through matching its multipath profiles to TR signatures in the training database G. By leveraging the TR technique, the dimensions of the CSI may be able to be naturally compressed through mapping them into the strength of the spatial-temporal resonances. The strength of the spatial-temporal resonance (TRRS) $TR(h_1, h_2)$ between two CSI samples $h_1$ and $h_2$ is defined as following equation (3):

$$\mathcal{TR}(h_1, h_2)=\left(\frac{\max_i|(h_1*g_2)[i]|}{\sqrt{\sum_{l=0}^{L-1}|h_1[l]|^2}\sqrt{\sum_{l=0}^{L-1}|h_2[l]|^2}}\right), \tag{3}$$

where "*" denotes the convolution and $g_2$ is the TR signature of $h_2$ as, $$g_2|k|=h_2^*|L-k-1|,k=0,1,\ldots,L-1.$$

During the online monitoring phase, the processor 104 keeps matching the current estimated CSI to the TR signature in G to find the one that yields the strongest TR spatial-temporal resonance, computed by the testing CSI matrix H and the signature matrix $G_i$ for each of the trained events $S_i$.

The similarity between CSI samples are quantified by the value of TRRS. When comparing the current CSI with the TR signature in the database, only when CSI samples are from the identical event will there be a strong spatial-temporal resonance.

In the embodiment of FIG. 1B, the access point device AP, the anchor node device 10 and the first electronic device 12 are disposed in the indoor space IS with a first door D1.

Similarly, to implement the indoor events detection in the indoor space IS based on the TR spatial-temporal resonances, the detection operation would include the offline training phase and the online testing phase.

During the offline training phase, two events are provided for establishing the preset CSI, which includes a first CSI and a normal CSI. The normal CSI corresponds to an event where the first door D1 is closed, and the first CSI corresponds to another event where the first door D1 is open. Specifically, the first CSI and the normal CSI are respectively obtained by performing a time-reversal operation on the probe signal in response to a first event and a normal event occurring in the indoor space IS.

Therefore, when the first door D1 is closed, the first wireless communication circuit 100 of the anchor node device 10 is configured to send a probe signal, the third wireless communication circuit 108 of the access point device AP is configured to receive the probe signal, and the processor 104 is configured to obtain the normal CSI from the probe signal by executing the TR process.

On the other hand, when the first door D1 is open, the first wireless communication circuit 100 of the anchor node device 10 is configured to send another probe signal, the third wireless communication circuit 108 of the access point device AP is configured to receive the probe signal, and the processor 104 is configured to obtain the first CSI from the probe signal by executing the TR process, that is, the preset CSI is a reversed and conjugated sequence of a CSI of the probe signal. The obtained first CSI and normal CSI are further stored in the memory 106.

Figure 1C:
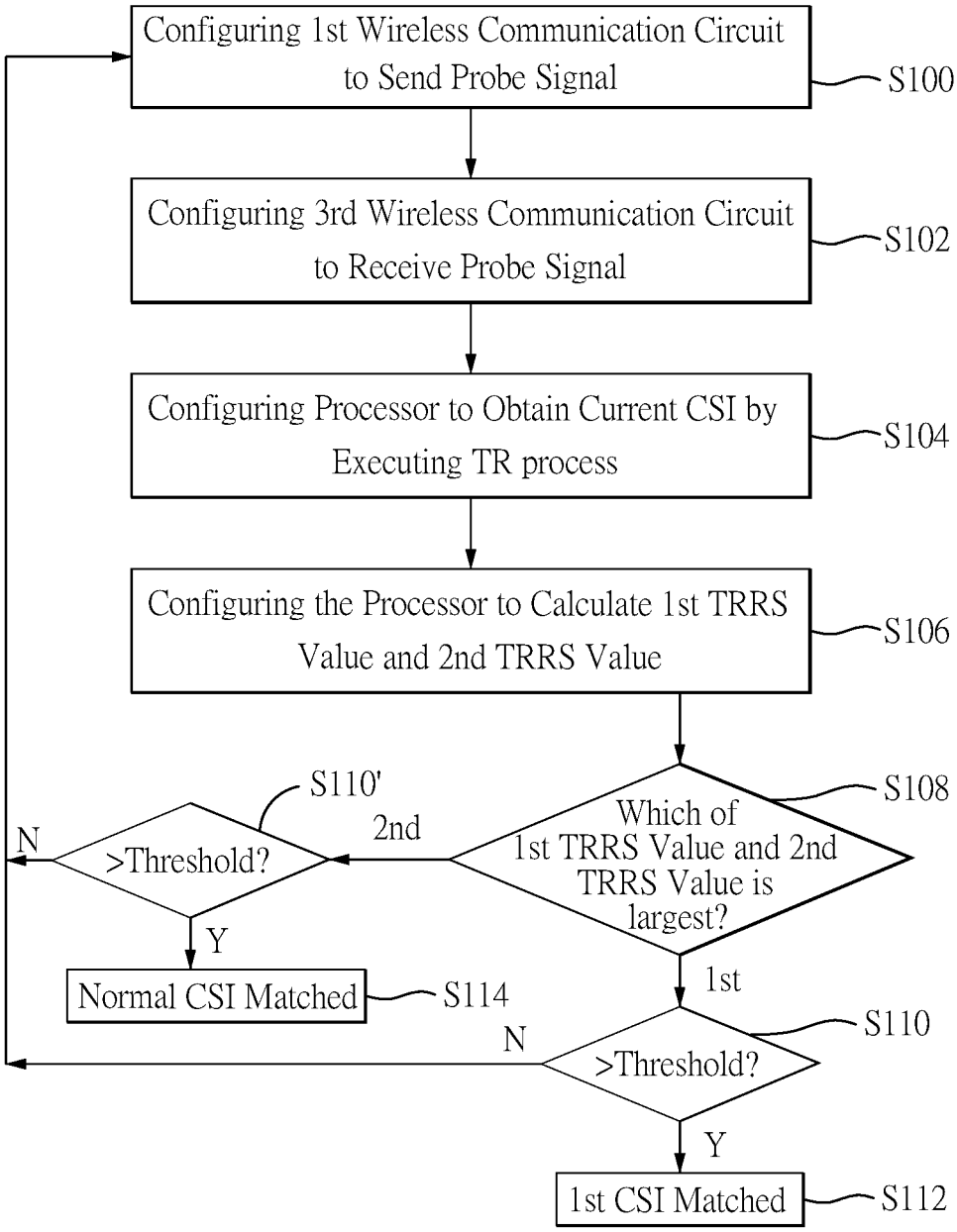
FIG. 1C shows a flow chart for detecting an indoor space according to an embodiment of the present disclosure.

Reference is now made to FIG. 1C, which shows a flow chart for detecting the indoor space according to an embodiment of the present disclosure. During the online monitoring phase, that is, step S100, the first wireless communication circuit 100 of the anchor node device 10 is configured to send a probe signal.

Step S102, the third wireless communication circuit 108 of the access point device AP is configured to receive the probe signal.

Step S104, the processor 104 is configured to obtain a current CSI from the probe signal by executing the TR process.

Step S106, the processor 104 is configured to calculate a first time-reversal resonating strength (TRRS) value between the current CSI and the first CSI, and a second TRRS value between the current CSI and the normal CSI.

After the first TRRS value and the second TRRS value are obtained, the method proceeds to step S108, in which the processor 104 is configured to determine which of the first TRRS value and the second TRRS value is largest, and proceed to step S110, to determine whether the first TRRS value and the second TRRS value larger than a threshold.

In this case, if the first TRRS value is larger than the second TRRS value and a threshold, the method proceeds to step S112, in which the first CSI is determined to be matched to the current CSI. If the second TRRS value is larger than the first TRRS value and the threshold, the method proceeds to step S114, the normal CSI is determined to be matched to the current CSI.

If the first TRRS value and the second TRRS value are smaller than the threshold, the method returns to step S100 to re-send the probe signal from the first wireless communication circuit 100.

Furthermore, when the first CSI is matched to the current CSI, the second wireless communication circuit 102 is configured to activate at least one function of the first electronic device 12 through the second communication protocol 1020.

In the present embodiment, the first electronic device 12 may be an electronic-controlled lamp, door lock, camera, audio system or other intelligent appliances, and the first electronic device 12 may be operated in a sleep mode. The sleep mode is a low power mode for the above mentioned electronic devices. This mode save significantly on electrical consumption compared to leaving a device fully on and, upon resuming, allows the user to avoid having to reissue instructions or to wait for a device to reboot. In this case, only the fourth wireless communication circuit 120 of the first electronic device 12 remains operation in the sleep mode, and may be configured to activate certain functions of the first electronic device 12 according to signals sent from the second wireless communication circuit 102 via the second communication protocol 1020 when the first CSI is matched to the current CSI. For example, if the first electronic device 12 is an electronically-controlled lamp, the lamp may be disposed adjacent to the first door D1, and may be turned on to provide illumination to an area adjacent to the first door D1 when the first CSI is matched to the current CSI. Therefore, when certain invasion events associated with the first door occurs causing the first door to be opened, the lamp may be turned on to provide an alerting illumination, otherwise the lamp remains turned off, such that the power consumption may be decreased.

In other embodiments, for example, if the first electronic device 12 is a camera device, an image capture function of the camera device may be configured to be activated when the first CSI is matched to the current CSI. Therefore, when any invasion event associated with the first door occurred causing the first door opened, the camera device may be woken up from the sleep mode while activating the image capture function, and otherwise the camera device remains in the sleep mode, such that the power consumption may be decreased.

The time-reversal indoor detection system of the present application concept utilizes TR wireless technology to solve the problem of power consumption of indoor surveillance systems, reduces the probability of misjudgment of PIR events, extend the scope of effective monitoring, reduces costs, and achieves the purpose of intensifying energy conservation and power saving.

Figure 2A:
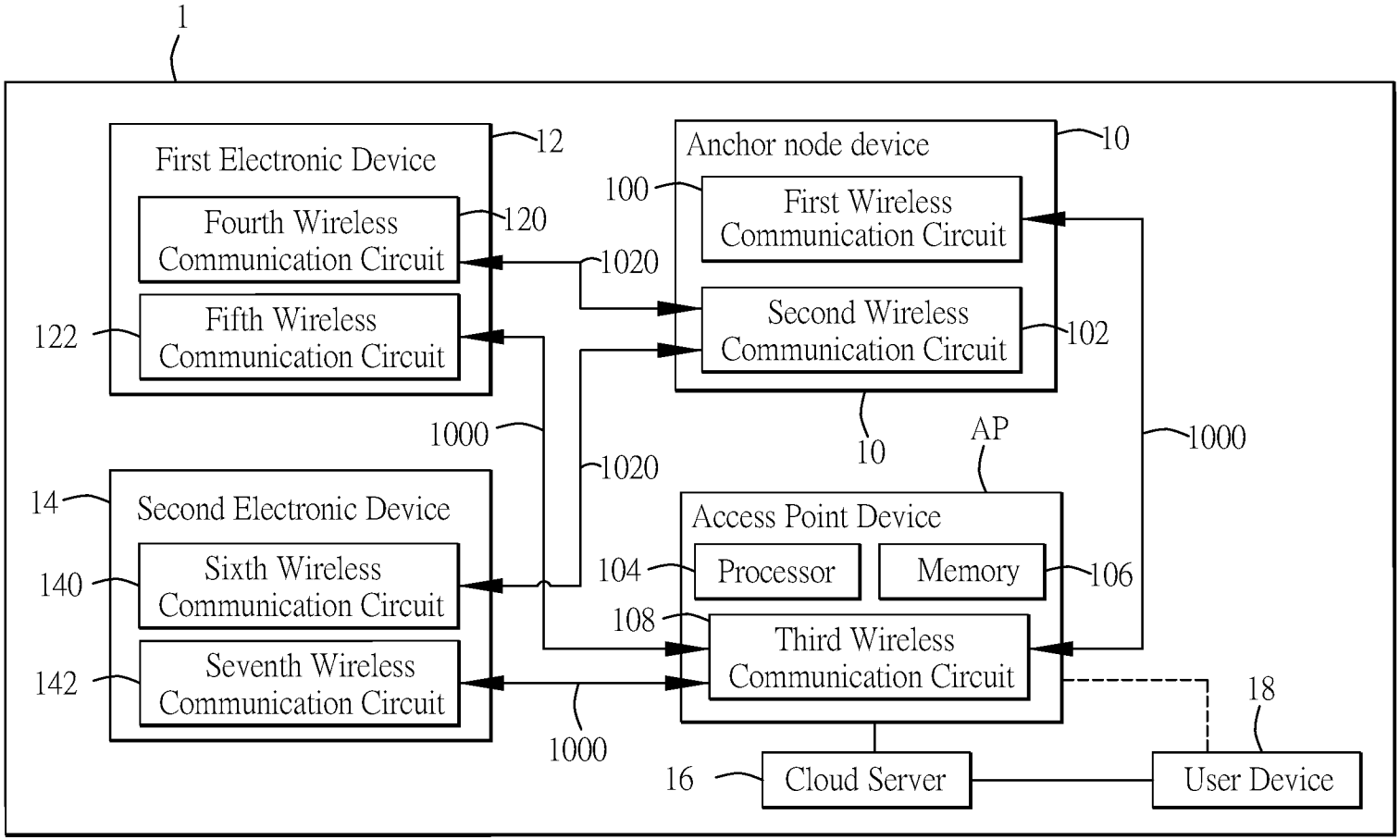
FIG. 2A shows a block diagram of the time-reversal indoor detection system according to another exemplary embodiment of the present disclosure.
Figure 2B:
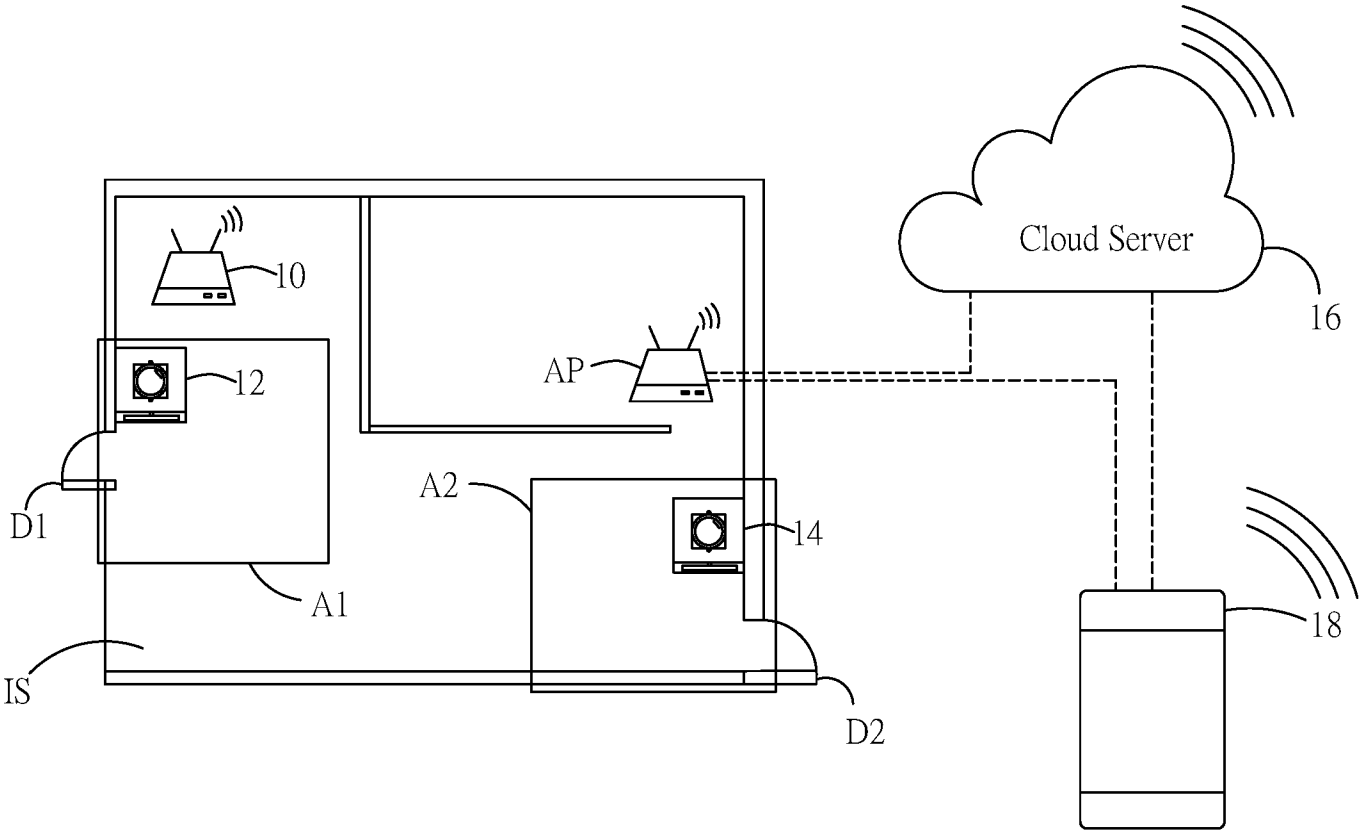
FIG. 2B shows a schematic diagram illustrating a layout of the time-reversal indoor detection system according to another embodiment of the present disclosure.

Reference is made to FIGS. 2A and 2B. In FIG. 2A, a block diagram of the time-reversal indoor detection system is further depicted in accordance with another exemplary embodiment, and FIG. 2B shows a schematic diagram illustrating a layout of the time-reversal indoor detection system according to another embodiment of the present disclosure.

As shown in FIG. 2A, the time-reversal indoor detection system 1 includes an anchor node device 10, an access point device AP, a first electronic device 12, a second electronic device 14, a cloud server 16, and a user device 18. In the exemplary embodiment, the anchor node 10 and the access point device AP are similar to their counterparts in the previous embodiments, so that details thereof are omitted herein. Specifically, the first electronic device 12 further includes a fifth wireless communication circuit 122 having the first communication protocol 1000, and communicates with the third wireless communication circuit 108 of the access point device AP through the first communication protocol 1000. The fifth wireless communication circuit 122 may be a Wi-Fi circuit or other wireless communication circuitry, which is configured to allow the first electronic device 12 to communicate with the access point device AP through the first communication protocol 1000.

Furthermore, the second electronic device 14 may be configured as the same as the first electronic device 12, and includes a sixth wireless communication circuit 140 and a seventh wireless communication 142.

In the exemplary embodiment, the sixth wireless communication circuit 140 may be a Bluetooth®, Z-Wave® or Zigbee circuit or other wireless communication circuitry, which may be configured to allow the second electronic device 14 to communicate with the anchor node device 10 through the second communication protocol 1020.

In the exemplary embodiment, the seventh wireless communication circuit 142 may be a Wi-Fi circuit or other wireless communication circuitry, which may be configured to allow the second electronic device 14 to communicate with the the third wireless communication circuit 108 of the access point device AP through the first communication protocol 1000.

In the exemplary embodiment, the fifth wireless communication circuit 122 of the first electronic device 12 and the seventh wireless communication circuit 142 of the second electronic device 14 operate with higher power than the fourth wireless communication circuit 120 and the sixth wireless communication circuit 140. The operations of the fourth, fifth, sixth, and seventh wireless communication circuits 120, 122, 140, and 142 will be described in more detail hereinafter.

Moreover, the access point device AP may be further connected to the cloud server 16, for example, via the network, and may be optionally connected to the user device 18. The cloud server may be inherently provided with a processor and a memory. The processor may be configured to obtain the preset CSI from the probe signal by executing the TR process as mentioned above, and the memory may store a table that defines the relationships between the defined events and the corresponding CSI. The processor may be further configured to calculate time-reversal resonating strength (TRRS) values between the current CSI and the preset CSI, and to keep matching the current CSI to the preset CSI stored in the memory to find the one that yields the strongest TR spatial-temporal resonance.

In addition, the user device 18 may include but not limited to, laptops, mobile devices and the like, and optionally connects to the access point device AP either directly or through the network or the cloud server 16. The user device 18 is provided with user interfaces, such that a user may control the first and second electronic devices 12 and 14, or may comprehend detection status in real-time through the network.

Reference is now made to FIG. 2B, the first electronic device 12 and the second electronic device 14 may be disposed in a first region A1 adjacent to a first door D1 and a second region A2 adjacent to a second door D2 of the indoor space IS, respectively. In this case, the memory 106 may store a preset channel state information (CSI), and the preset CSI includes a first CSI, a second CSI and a normal CSI. Specifically, the first CSI, the second CSI, and the normal CSI are respectively obtained by performing a time-reversal operation on the probe signal in response to a first event, a second event, and a normal event occurring in the indoor space IS. The normal event may be defined as there not occurring any invasion event in the indoor space IS, the first event may be defined as the door D1 being opened, and the second event may be defined as the door D2 being opened.

Similarly, to implement the indoor events detection in the indoor space IS based on the TR spatial-temporal resonances, the detection operation would include the offline training phase and the online testing phase.

During the offline training phase, three events are provided for establishing the preset CSI, which includes a first CSI, a second CSI and a normal CSI. The normal CSI corresponds to an event where the first door D1 and the second door D2 are closed, the first CSI corresponds to another event where the first door D1 is open, and the second CSI corresponds to yet another event where the second door D2 is open.

Therefore, when the first door D1 and the second door D2 are closed, the first wireless communication circuit 100 of the anchor node device 10 is configured to send a probe signal, the third wireless communication circuit 108 of the access point device AP is configured to receive the probe signal, and the processor 104 is configured to obtain the normal CSI from the probe signal by executing the TR process.

On the other hand, when the first door D1 is open, the first wireless communication circuit 100 of the anchor node device 10 is configured to send another probe signal, the third wireless communication circuit 108 of the access point device AP is configured to receive the probe signal, and the processor 104 is configured to obtain the first CSI from the probe signal by executing the TR process, and the second CSI is obtained with a similar approach as the first CSI, except that the second CSI is obtained when the second door D2 is open. Similarly, the preset CSI is a reverse sequence of a CSI of the probe signal. The obtained first CSI, second CSI, and normal CSI are further stored in the memory 106, or stored in the memory of the cloud server 16.

Figure 2C:
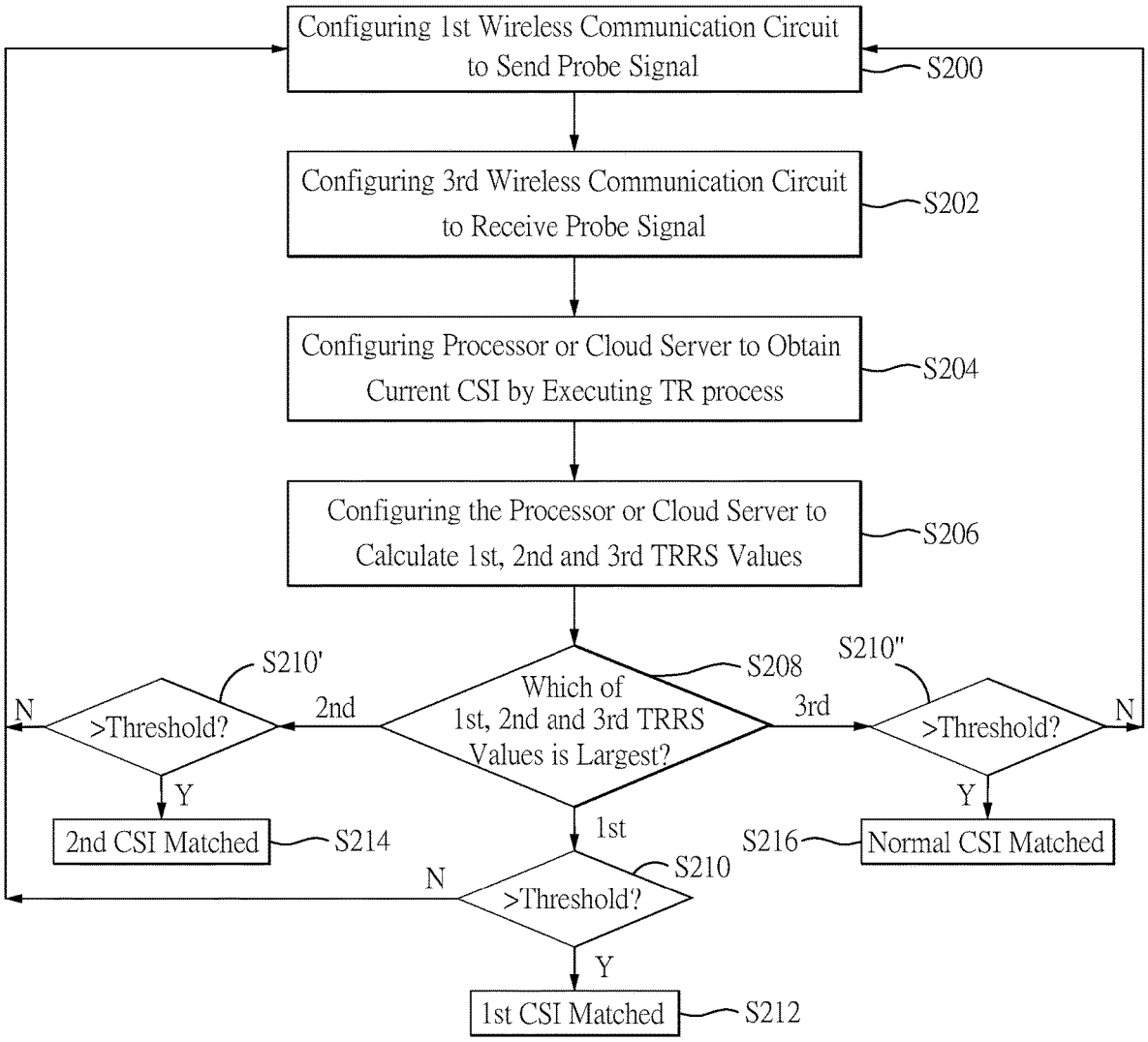
FIG. 2C shows a flow chart for detecting an indoor space according to another embodiment of the present disclosure.

Reference is now made to FIG. 2C, which shows a flow chart for detecting the indoor space according to another embodiment of the present disclosure. During the online monitoring phase, that is, step S200, the first wireless communication circuit 100 of the anchor node device 10 is configured to send a probe signal.

In step S202, the third wireless communication circuit 108 of the access point device AP is configured to receive the probe signal.

In step S204, the processor 104 or the cloud server 16 is configured to obtain a current CSI from the probe signal by executing the TR process.

In step S206, the processor 104 is configured to calculate a first time-reversal resonating strength (TRRS) value between the current CSI and the first CSI, a second TRRS value between the current CSI and the second CSI, and a third TRRS value between the current CSI and the normal CSI.

After the first, second, and third TRRS values are obtained, the method proceeds to step S208, in which the processor 104 or the cloud server 16 is configured to determine which of the first, second, and third TRRS values is largest, and proceed to step S210, step S210', or step 210", to determine whether the first, second, and third TRRS values are larger than a threshold.

In this case, if the first TRRS value is larger than the second and third TRRS values and a threshold, the method proceeds to step S212, in which the first CSI is determined to be matched to the current CSI. If the second TRRS value is larger than the first and third TRRS values and the threshold, the method proceeds to step S214, in which the second CSI is determined to be matched to the current CSI. If the third TRRS value is larger than the first and second TRRS values and the threshold, the method proceeds to step S216, in which the normal CSI is determined to be matched to the current CSI.

If the first, second and third TRRS values are smaller than the threshold, the method returns to step S200 to re-send the probe signal from the first wireless communication circuit 100.

Furthermore, when the first CSI is matched to the current CSI, the second wireless communication circuit 102 is configured to activate at least one function of the first electronic device 12 through the second communication protocol 1020, and when the second CSI is matched to the current CSI, the second wireless communication circuit 102 is configured to activate at least one function of the second electronic device 12 through the second communication protocol 1020.

In this case, another event may be further provided for establishing the preset CSI during the offline training phase, for example, a third CSI may be included in the preset CSI. The third CSI corresponds to an event where the first door D1 and the second door D2 are both open. Similarly, when the first door D1 and the second door D2 are both open, the first wireless communication circuit 100 of the anchor node device 10 is configured to send the probe signal, the third wireless communication circuit 108 of the access point device AP is configured to receive the probe signal, and the processor 104 is configured to obtain the third CSI from the probe signal by executing the TR process.

Therefore, step S206 may be modified by further configuring the processor 104 to calculate a fourth TRRS value between the current CSI and the third CSI, and step S208 may be modified by configuring the processor 104 or the cloud server 16 to determine which of the first, second, third, and fourth TRRS values is largest. Another step may be provided to determine whether the first, second, third, and fourth TRRS values are larger than a threshold. If the fourth TRRS value is larger than the first, second, and third TRRS values and the threshold, the third CSI is determined to be matched to the current CSI. That is, the event that the first door D1 and the second door D2 are both open is determined to have occurred.

Moreover, supposing that the first electronic device 12 and the second electronic device 14 are both camera devices, the first electronic device 12 and the second electronic device 14 may each include a processor unit, for example, micro-controller unit (MCU), a camera, a low power radio circuit as the fourth wireless communication circuit 120 and/or the sixth wireless communication circuit 140, a Wi-Fi circuit as the fifth wireless communication circuit 122 and/or the seventh wireless communication circuit 142, and a memory.

Specifically, the first electronic device 12 and the second electronic device 14 may operate in an active mode and a sleep mode. The sleep mode is sometimes referred to as a standby or suspend mode, and is a power-sparing state that an electronic device can enter when not in use. The state of the electronic device is stored in a memory, e.g., a RAM (random access memory). When the electronic device enters the sleep mode, power is cut from any unneeded systems, while the RAM receives just enough power to enable it to store data.

Furthermore, in the sleep mode, the low power radio circuit, for example, the fourth wireless communication circuit 120 and/or the sixth wireless communication circuit 140 are/is configured to retain the minimum power consumption state, and may receive signals. The low power radio circuit may be activated to enter the active mode in a period with specific time intervals by using a timer, or may be activated to enter the active mode when a certain event is detected by the time-reversal indoor detection system.

Detailed operational statuses in the sleep mode of the low power radio circuit are provided in the following Table I:

TABLE I

| Function | Status |
|---|---|
| RADIO SWITCHING | DISABLE |
| RADIO TRANSMISSION | DISABLE |
| RADIO RECEPTION | DISABLE |
| RADIO SLEEPING | ENABLE |

When the low power radio circuit enters the active mode, functions of data processing, data sending, and data receiving are performed, and other component may be further activated. For example, the camera may be activated after the low power radio circuit enters the active mode.

Detailed operational statuses in the active mode of the low power radio circuit are provided in the following Table II:

TABLE II

| Function | Status |
|---|---|
| RADIO SWITCHING | Enable |
| RADIO TRANSMISSION | Enable |
| RADIO RECEPTION | Enable |
| RADIO SLEEPING | Disable |

Moreover, in the sleep mode, the MCU suspends most or all of its operations to minimize energy consumption. The MCU's low-frequency clock oscillator remains running, but the clock tree that drives the MCU circuitry is disabled. This enables the MCU to resume executing instructions on the next clock cycle following the wake-up trigger. In the active mode, the MCU returns to an active state and resume program execution.

In the exemplary embodiment, the first electronic device 12 and the second electronic device 14 (i.e., the camera devices) may be configured to operate in various operation phases, such as a monitoring phase, a recording phase, a data uploading phase, and a streaming phase. The operation phases are performed according to different conditions. For example, after the first CSI is determined to be matched to the current CSI, or after the second CSI is determined to be matched to the current CSI; that is, certain invasion events may occur causing the first door D1 or the second door D2 to be opened. The third wireless communication circuit 108 may be further configured to send a request signal to the first wireless communication circuit 100, and the second wireless communication circuit 102 is then configured to change an operation mode of the fourth wireless communication circuit 120 or the sixth wireless communication circuit 140 of the first electronic device 12 or the second electronic device 14 from the sleep mode to the active mode, and the first electronic device 12 or the second electronic device 14 may be operated in various phases according to a type of the request signal.

Detailed operational statuses in the monitoring phase, recording phase, data uploading phase, and streaming phase of the first electronic device 12 or the second electronic device 14 are provided in the following Table III:

TABLE III

| Component | Monitoring Phase | Recording Phase | Data Uploading Phase | Streaming Phase |
|---|---|---|---|---|
| Low Power Radio Circuit | Sleep Mode | Active Mode-> Sleep Mode | Sleep Mode | Sleep Mode |
| Camera | Turn Off | Active Mode | Active Mode | Active Mode |
| Wi-Fi Circuit | Turn Off | Turn Off | Active Mode | Active Mode |
| MCU | Sleep Mode | Active Mode | Active Mode | Active Mode |

Types of the request signal may include but are not limited to, snapshot request signals, recording request signals, and streaming request signals. For example, when the current CSI is determined to be matched to the first CSI, that is, the event corresponding to the first door D1 being opened, the third wireless communication circuit 108 may be configured to send a recording request signal to the first wireless communication circuit 100, and the second wireless communication circuit is then configured to change an operation mode of the fifth wireless communication circuit 122 from the sleep mode to the active mode, and the first electronic device 12 is configured to operate in the recording phase according to the recording request signal. In the recording phase, the low power circuit is configured to be changed from the active mode to the sleep mode as long as the camera is activated. The camera is configured to be changed from a turn-off mode to the active mode while enabling recording function, the Wi-Fi circuit remains in the turn-off mode because there is no request for transmitting image data to access point device AP, and the MCU is configured to be changed from the sleep mode to the active mode to execute related processes, such as a built-in recording program that may adjust directions, recording time, focus length, or other relevant parameters of the camera, and may generate video files for being stored in the memory.

After a specific time interval, or the access point device AP or the cloud server 16 sends a record-terminating signal, the first electronic device 12 may be configured to enter the data uploading phase or streaming phase. In the data uploading phase or streaming phase, the fifth wireless communication circuit, e.g., the Wi-Fi circuit, is configured to change the operation mode from the turn-off mode to the active mode while the image files stored in the memory may be uploaded to the cloud server 16 or streamed to the user device 18 through the access point device AP.

Figure 3:
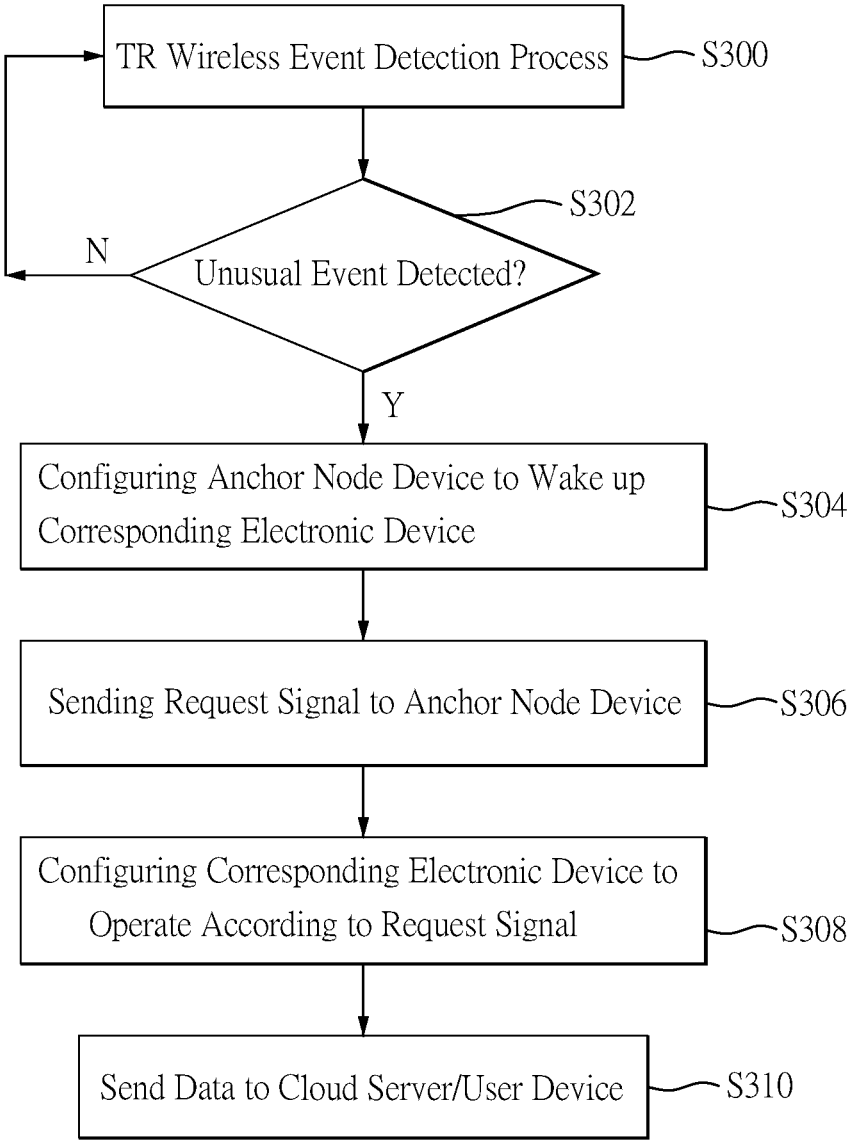
FIG. 3 shows a flow chart of a time-reversal indoor detection method according to an embodiment of the present disclosure.

Reference is now made to FIG. 3, which shows a flow chart of a time-reversal indoor detection method according to an embodiment of the present disclosure. The time-reversal indoor detection method is depicted based on the time-reversal indoor detection system provided in the embodiments as shown in FIG. 2A to 2C.

In step S300, the anchor node device 10 and the access point device AP is configured to perform the TR wireless event detection process, as mentioned in FIG. 2C.

In step S302, the access point device AP or the cloud server 16 is configured to determine whether any unusual event is detected. That is, the first CSI or the second CSI is determined to be matched to the current CSI. If not, the method may return to step S300. If yes, the method may proceed to step S304.

In step S304, the anchor node is configured to wake up the corresponding electronic device. That is, the electronic device corresponding to the detected unusual event may be configured to be changed from the sleep mode to the active mode, and furthermore, at least one function of the electronic device corresponding to the detected unusual event may be activated.

In step S306, the access point device AP or the cloud server 16 is configured to send the request signal to the anchor node device 10, for example, the snapshot request signal, the recording request signal, or the streaming request signal.

In step S308, the corresponding electronic device is configured to operate according to the request signal, for example, operate in the monitoring phase, recording phase, data uploading phase, and streaming phase. Detailed operational statuses in the monitoring phase, recording phase, data uploading phase, and streaming phase of the electronic device are provided in the above mentioned Table III.

In step S310, the corresponding electronic device is configured to send data to the cloud server 16 or the user device 18 through the access point device AP.

According to the previous embodiments, only one normal event may be defined in the offline training phase, and all of the electronic devices may be triggered to perform the recording phase or the streaming phase if any unusual event is detected.

Figure 4:
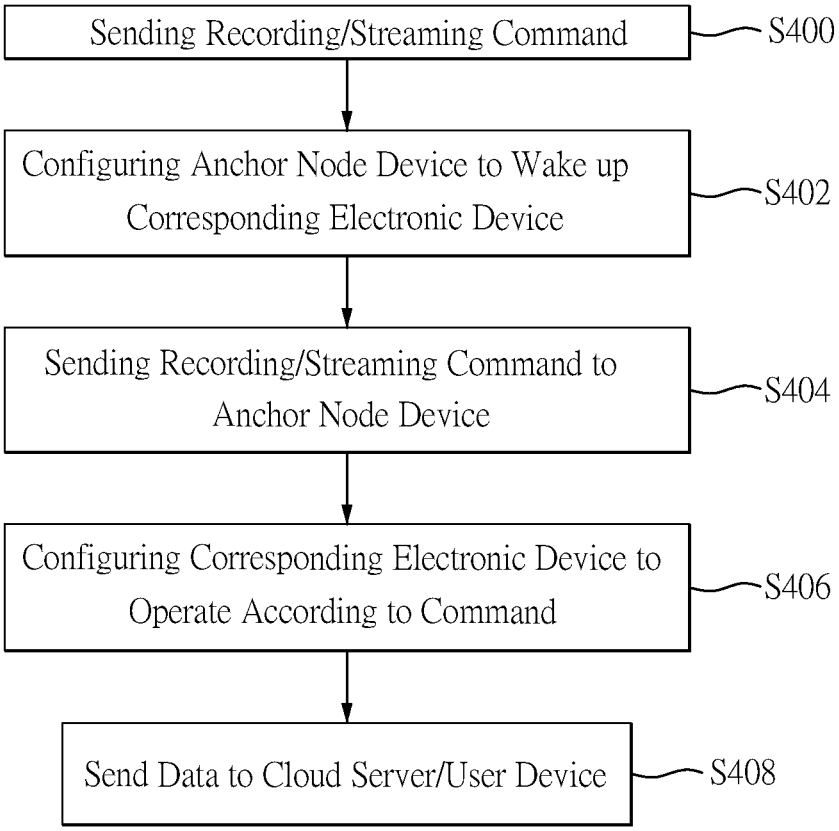
FIG. 4 shows another flow chart of a time-reversal indoor detection method according to yet another embodiment of the present disclosure.

Reference is now made to FIG. 4, which shows another flow chart of a time-reversal indoor detection method according to yet another embodiment of the present disclosure. The time-reversal indoor detection method according to a command from the user device is depicted based on the time-reversal indoor detection system provided in the embodiments as shown in FIG. 2A to 2C.

In the exemplary embodiment, the time-reversal indoor detection system provides another option for user to actively monitor the indoor space.

In step S400, user(s) may send a recording/streaming command from the user device 18 to the cloud server 16 or the access point device AP through the user interface.

In step S402, the anchor node is configured to wake up the corresponding electronic device. That is, the electronic device corresponding to the recording/streaming command may be configured to be changed from the sleep mode to the active mode, and furthermore, at least one function of the electronic device corresponding to the recording/streaming command may be activated.

In step S404, the access point device AP or the cloud server 16 is configured to send the recording/streaming command to the anchor node device 10, for example, the snapshot request signal, the recording request signal, or the streaming request signal.

In step S406, the corresponding electronic device is configured to operate according to the recording/streaming command, for example, operate in the monitoring phase, recording phase, data uploading phase, and streaming phase. Detailed operational statuses in the monitoring phase, recording phase, data uploading phase, and streaming phase of the electronic device are provided in the above mentioned Table III.

In step S408, the corresponding electronic device is configured to send data to the cloud server 16 or the user device 18 through the access point device AP.

Since a Non-Line-Of-Sight (NLOS) environment can be processed by the TR wireless technology, after any unusual event is detected, the anchor node device can notify the camera in the corresponding region and can drive the camera device to rotate or move the view angle to the scene where the detected event took place, and perform the recording phase or streaming phase for video recording. Since the video recording may be dynamically performed according to the regions of the detected events, the unusual events can be tracked along their routes so that the entire event can be captured.

In the above embodiments, only one anchor node device is provided, but the number of the anchor node is not limited to one; multiple anchor node devices may be provided in the indoor space, and may each be paired with multiple electronic devices, such as the first and second electronic devices mentioned above. The multiple anchor devices may each pair with one camera device, and may be disposed in different regions in the indoor space, respectively, that is, one anchor node device is paired with one camera device in one region. Therefore, the online monitoring phase may be performed between one of the anchor node devices and the access point device, that is, one of the anchor node devices performs TR wireless process with the access point device. If an unusual event or comparison result is detected, and matches with one event stored in the memory, the anchor node device wakes up the camera device paired with it to, for example, record a video.

If one anchor node device is paired to multiple camera devices, the online monitoring phase can be performed with reference made to the above regional detection provided in the above embodiments, and the camera devices may be individually woken up, depending on the relationship between the event, the preset CSI, and the corresponding camera device(s) established in the offline training phase.

The time-reversal indoor detection system and method of the present disclosure utilize TR wireless technology to eliminate the drawback of high power consumption of existing surveillance camera systems. For example, when the camera in the electronic device is not needed for capturing images or transmitting image data to AP, the camera and Wi-Fi circuit may be turned off, and the low power radio circuit may then be configured to enter the sleep mode. Compared to the existing camera device equipped with the PIR sensor, which needs to operate in the active mode for continuously detecting the indoor space, a Wi-Fi circuit may stay in sleep mode, so that the power consumption of the time-reversal indoor detection system and method of the present disclosure may be lower, and the lifetime of the camera device may be longer.

Furthermore, the time-reversal indoor detection system and method of the present disclosure may reduce the probability of misjudgment of PIR events, alleviate the restrictions associated with viewing angles of existing surveillance camera systems, extend the effective scope of surveillance, reduce costs, and improve the significance of recorded surveillance content.

The description of the different exemplary embodiments has been presented for purposes of illustration and description, and is not intended to be exhaustive or limited to the disclosure in the form disclosed. Many modifications and variations will be apparent to those of ordinary skill in the art. Further, different exemplary embodiments may provide different advantages as compared to other exemplary embodiments. The embodiment or embodiments selected are chosen and described in order to best explain the principles of the disclosure, the practical application, and to enable others of ordinary skill in the art to understand the disclosure for various embodiments with various modifications as are suited to the particular use contemplated.

What is claimed is:

1. A time-reversal indoor detection system, comprising:

an anchor node device, including:

a first wireless communication circuit supporting a first communication protocol; and a second wireless communication circuit supporting a second communication protocol;

an access point (AP) device, comprising:

a processor;

a memory connected to the processor, configured to store a preset channel state information (CSI), wherein the preset CSI includes a first CSI and a normal CSI; and a third wireless communication circuit supporting the first communication protocol and connected to the processor, communicating with the first wireless communication circuit through the first communication protocol within an indoor space; and a first electronic device, including a fourth wireless communication circuit supporting the second communication protocol, and communicating with the second communication circuit through the second communication protocol, wherein the first wireless communication circuit is configured to send a probe signal, wherein the third wireless communication circuit is configured to receive the probe signal, wherein the processor is configured to obtain a current CSI from the probe signal, and to compare the current CSI to the preset CSI, and wherein when the first CSI is matched to the current CSI, the second wireless communication circuit is configured to activate at least one function of the first electronic device through the second communication protocol, wherein the processor is configured to calculate a first time-reversal resonating strength (TRRS) value between the current CSI and the first CSI, and a second TRRS value between the current CSI and the normal CSI, and wherein the first CSI is determined to be matched to the current CSI if the first TRRS value is larger than the second TRRS value and a threshold.

2. The time-reversal indoor detection system according to claim 1, wherein the preset CSI is a reversed and conjugated sequence of a CSI of the probe signal.

3. The time-reversal indoor detection system according to claim 1, wherein an operation power of the first wireless communication circuit is higher than an operation power of the second wireless communication circuit.

4. The time-reversal indoor detection system according to claim 3, wherein the first electronic device further includes a fifth wireless communication circuit supporting the first communication protocol, and communicating with the third wireless communication circuit through the first communication protocol.

5. The time-reversal indoor detection system according to claim 4 wherein the first electronic device is a camera device, and an image capture function of the camera device is configured to be activated when the first CSI is matched to the current CSI.

6. The time-reversal indoor detection system according to claim 5, wherein the third wireless communication circuit is further configured to send a request signal to the first wireless communication circuit, and the second wireless communication circuit is configured to change an operation mode of the fifth wireless communication circuit from a turn-off mode to an active mode according to the request signal.

7. The time-reversal indoor detection system according to claim 1, wherein the first CSI and the normal CSI are respectively obtained by performing a time-reversal operation on the probe signal in response to a first event and a normal event occurring in the indoor space.

8. The time-reversal indoor detection system according to claim 1, further comprising a second electronic device configured to be the same as the first electronic device, wherein the first electronic device and the second electronic device are disposed in a first region and a second region of the indoor space, respectively, wherein the preset CSI further includes a second CSI, and wherein the second wireless communication circuit is configured to activate at least one function of the second electronic device when the second CSI is matched to the current CSI.

9. The time-reversal indoor detection system according to claim 8, wherein the first CSI, the second CSI and the normal CSI are respectively a reverse sequence of a CSI of the probe signal in response to a first event occurring in the first region of the indoor space, a second event occurring in the second region of the indoor space and a normal event occurring in the indoor space.

10. A time-reversal indoor detection method, comprising:

communicating a first wireless communication circuit of an anchor node device with a third wireless communication circuit of an access point device through a first communication protocol within an indoor space, wherein the access point device further includes a processor, and a memory connected to the processor, the memory is configured to store a preset channel state information (CSI), and wherein the preset CSI includes a first CSI and a normal CSI;

communicating a second communication circuit of the anchor node device with a fourth wireless communication circuit of a first electronic device through a second communication protocol;

configuring the first wireless communication circuit to send a probe signal;

configuring the third wireless communication circuit to receive the probe signal; and configuring the processor to obtain a current CSI from the probing signal, and to compare the current CSI to the preset CSI, wherein when the first CSI is matched to the current CSI, the second communication circuit is configured to activate at least one function of the first electronic device through the second communication protocol; and configuring the processor to calculate a first time-reversal resonating strength (TRRS) value between the current CSI and the first CSI, and a second TRRS value between the current CSI and the normal CSI, wherein the first CSI is determined to be matched to the current CSI when the first TRRS value is larger than the second TRRS value and a threshold.

11. The time-reversal indoor detection method according to claim 10, wherein the preset CSI is a reverse sequence of a CSI of the probe signal.

12. The time-reversal indoor detection method according to claim 10, wherein an operation power of the first communication protocol is higher than an operation power of the second communication.

13. The time-reversal indoor detection method according to claim 12, further comprising:

configuring a fifth wireless communication circuit of the first electronic device to communicate with the third wireless communication circuit through the first communication protocol.

14. The time-reversal indoor detection system according to claim 13, wherein the first electronic device is a camera device, and an image capture function of the camera device is configured to be activated when the first CSI is matched to the current CSI.

15. The time-reversal indoor detection method according to claim 14, further comprising:

configuring the third wireless communication circuit to send a request signal to the first wireless communication circuit; and configuring the second wireless communication circuit to change an operation mode of the fifth wireless communication circuit from a turn-off mode to an active mode according to the request signal.

16. The time-reversal indoor detection method according to claim 10, further comprising:

respectively obtaining the first CSI and the normal CSI by performing a time-reversal operation on the probe signal in response to a first event and a normal event occurring in the indoor space.

17. The time-reversal indoor detection method according to claim 10, further comprising:

configuring a second electronic device to be the same as the first electronic device, wherein the first electronic device and the second electronic device are disposed in a first region and a second region of the indoor space, respectively, wherein the preset CSI further includes a second CSI;

configuring the second wireless communication circuit to activate at least one function of the second electronic device when the second CSI is matched to the current CSI.

18. The time-reversal indoor detection method according to claim 17, further comprising:

storing the first CSI, the second CSI and the normal CSI, wherein the first CSI, the second CSI and the normal CSI are respectively a reverse sequence of a CSI of the probe signal in response to a first event occurring in the first region of the indoor space, a second event occurring in the second region of the indoor space and a normal event occurring in the indoor space.

* * * * *